US010224163B2

(12) United States Patent
Freitas et al.

(10) Patent No.: US 10,224,163 B2
(45) Date of Patent: Mar. 5, 2019

(54) CIRCUIT BREAKER HOUSING AND METHOD OF ASSEMBLING

(71) Applicant: General Electric Company, Schenectady, NY (US)

(72) Inventors: Mari Keiko Freitas, Plainville, CT (US); Enamul Haque, Plainville, CT (US); Wolfgang Meyer-Haack, Plainville, CT (US); Dhirendra Tiwari, Farmington, CT (US)

( * ) Notice: Subject to any disclaimer, the term of this patent is extended or adjusted under 35 U.S.C. 154(b) by 0 days.

(21) Appl. No.: 15/557,819

(22) PCT Filed: Mar. 11, 2016

(86) PCT No.: PCT/US2016/021975
§ 371 (c)(1),
(2) Date: Sep. 13, 2017

(87) PCT Pub. No.: WO2016/149084
PCT Pub. Date: Sep. 22, 2016

(65) Prior Publication Data

US 2018/0047531 A1 Feb. 15, 2018

Related U.S. Application Data

(60) Provisional application No. 62/132,787, filed on Mar. 13, 2015.

(51) Int. Cl.
*H01H 33/53* (2006.01)
*H01H 71/02* (2006.01)
(Continued)

(52) U.S. Cl.
CPC ..... *H01H 33/53* (2013.01); *H01H 33/08* (2013.01); *H01H 71/025* (2013.01);
(Continued)

(58) Field of Classification Search
CPC ..... H01H 2033/6623; H01H 33/66207; H01H 33/666; H01H 73/18; H01H 9/342;
(Continued)

(56) References Cited

U.S. PATENT DOCUMENTS 3,780,249 A * 12/1973 Harper ..... H01H 9/04 200/302.3
4,660,009 A * 4/1987 Wafer ..... H01H 71/2418 335/16

(Continued)

FOREIGN PATENT DOCUMENTS

DE 7713388 U1 1/1978
DE 102012111391 A1 5/2014
WO 2012164319 A2 12/2012

OTHER PUBLICATIONS

International Search Report and Written Opinion issued in connection with corresponding PCT application No. PCT/US2016/021975 dated Jun. 15, 2016.

*Primary Examiner* — Truc Nguyen
(74) *Attorney, Agent, or Firm* — Barnes & Thornburg LLP

(57) ABSTRACT

A circuit breaker housing assembly is disclosed. The housing (47) includes a first housing piece (14) defining a first interior surface (52) including a first mating surface (152), and a second housing piece (60) defining a second interior surface (62) including a second mating surface (260) which is opposingly coupled to the first mating surface to define a seam (202) therebetween. An adhesive material (201) is disposed between the corresponding first and second mating surfaces along the seam. A moveable contact is disposed in the housing and is selectively moveable with respect to a corresponding stationary contact. The first and second interior surfaces (52,62) further cooperatively define a first recess (120) therebetween, and the moveable contact assembly is disposed in said first recess.

13 Claims, 14 Drawing Sheets

(51) Int. Cl.
*H01H 33/08* (2006.01)
*H01H 1/20* (2006.01)
*H01H 73/04* (2006.01)

(52) U.S. Cl.
CPC ..... *H01H 1/2058* (2013.01); *H01H 71/0257* (2013.01); *H01H 73/045* (2013.01)

(58) Field of Classification Search
CPC ..... H01H 31/003; H01H 33/022; H01H 33/6606; H01H 9/302; H01H 9/36; H01H 9/362; H01H 1/5822; H01H 2033/6613; H01H 33/027
See application file for complete search history.

(56) References Cited

U.S. PATENT DOCUMENTS 4,951,019 A * 8/1990 Gula ..... H01H 71/501 200/401
5,321,378 A * 6/1994 Ferullo ..... H01H 71/125 335/202
5,836,441 A 11/1998 Scheel et al.
6,204,465 B1 * 3/2001 Gula ..... H01H 77/105 218/154
6,239,398 B1 5/2001 Doughty
7,566,841 B2 * 7/2009 McCoy ..... H01H 50/002 200/331
8,093,984 B2 * 1/2012 Hofmann ..... H01H 71/1081 218/151
8,390,406 B2 * 3/2013 An ..... H01H 73/18 218/35
8,553,394 B2 10/2013 Hawkins et al.
8,836,453 B2 9/2014 Yang et al.
2002/0050891 A1 5/2002 Castonguay et al.
2005/0046528 A1 3/2005 Ciarcia et al.
2012/0120558 A1 * 5/2012 Raabe ..... H01H 9/342 361/619
2012/0186957 A1 7/2012 Ahlert et al.
2014/0055902 A1 * 2/2014 Ahlert ..... H01H 9/30 361/115
2014/0090963 A1 4/2014 Sudhakar et al.
2014/0118889 A1 5/2014 Mills et al.

* cited by examiner

CIRCUIT BREAKER HOUSING AND METHOD OF ASSEMBLING

CROSS-REFERENCE TO RELATED APPLICATIONS

This application is a U.S. national stage of International Application Serial No. PCT/US2016/021975, filed Mar. 11, 2016, which claims priority to U.S. Provisional Patent Application No. 62/132,787, filed Mar. 13, 2015.

BACKGROUND OF THE INVENTION

This invention relates generally to a switching device, and, more particularly, to a circuit breaker having an insulative housing.

Circuit breakers are one of a variety of switching devices, such as overcurrent protective devices, used for electrical circuit protection and isolation. A basic function of a circuit breaker may be to provide electrical system protection when an electrical abnormality (such as a short-circuit or other fault condition) occurs in any part of the circuit. In such devices, a moveable electrical contact is typically selectively engageable with a corresponding stationary contact to enable current flow. When a fault condition is detected, the circuit breaker moveable contact is automatically disengaged from the stationary contact to thereby disable current flow through the circuit. Such separating of the contacts may typically result in an arcing condition or event within the circuit breaker. To ensure the electrically live parts such as the separable contacts remain insulated, and to protect users from any arcing conditions, circuit breakers are typically constructed using a molded plastic housing or cassette enclosing the separable contacts.

In a typical rotary contact circuit breaker, electrical current enters the system from a power line. A conductive line-side strap and a conductive load-side strap typically protrude from the circuit breaker housing to facilitate connection with conductors in the electrical circuit. The current passes through the conductive line-side contact strap to a stationary contact fixed on a portion of the conductive strap within the circuit breaker housing, and then to a moveable contact. The moveable contact is fixedly attached to a conductive arm, and the arm is mounted to a rotor that is rotatably mounted in a cassette-type housing. As long as the fixed contact is engaged with, or in physical contact with, the moveable contact, the current passes from the fixed contacts to the moveable contacts to a portion of the conductive load-side contact strap disposed within the circuit breaker housing, and out of the circuit breaker via conductive cable coupled to the load-side contact strap and then to downline electrical devices or loads.

Typically, the circuit breaker housing, or cassette, is formed of two insulative mating housing portions rigidly coupled together with mechanical fasteners such as rivets. When coupled together, the two housing portions, or half-pieces, may define a seam along their corresponding mating surfaces, and further define at least one interior cavity between the mating housing portions or cassette half-pieces for housing the circuit breaker conductive parts, mechanisms, and arc chute assemblies. Additionally openings in the housing may allow the line-side and load side straps to protrude from the housing to enable connection to external circuit wiring.

In some instances, such as multi-pole circuit breakers of the type used in a three-phase electrical system, several conventional single-pole circuit breaker devices may each be housed in an individual cassette, and these cassettes, may be further cooperatively enclosed in a single conventional multi-pole circuit breaker housing.

In the event of an overcurrent condition (e.g. a short circuit), extremely high electro-magnetic forces are generated. These electro-magnetic forces repel the movable contact away from the stationary contact. In other cases, a tripping mechanism disposed within the circuit breaker housing acts to drive the movable contact away from the stationary contact. For example, when the moveable contact is fixedly attached to a rotatable arm, and the moveable contact is in contact with the stationary contact, it defines an "ON" condition for the circuit breaker. When the rotatable arm is pivoted to physically separate the stationary and moveable contacts, the circuit breaker is thereby switched to the "tripped" or "off" condition. When the circuit breaker contacts are rapidly opened or tripped, for example due to a detected short-circuit event, an electrical arc is produced between the contacts. Accordingly, there occurs a voltage corresponding to the source voltage between the stationary contact and the moveable contact, thereby carrying out the circuit breaker operation. It is common practice to employ an arc chute assembly to help extinguish this resultant arc.

Additionally, during such an arcing event, high-temperature ionized gasses are generated due to the arc, with resultant high pressure forces likewise being developed within the housing interior cavity. The ionized gas temperatures can reach or exceed 20,000° C. for several milliseconds, which can vaporize the conductors and adjacent equipment. Moreover, an arc flash can release significant energy in the form of heat, intense light, pressure waves, and/or sound waves.

Such ionized gases may conventionally be intentionally discharged through specific exhaust vent openings arranged in the circuit breaker housing. However, if the ionized gases are unintentionally discharged from even the smallest of openings, such as along a seam or other small openings in the housing around the line-side contact strap and load-side contact strap, the gases could transfer to an adjacent circuit breaker, or to nearby bus bar conductors, resulting in a phase-to-phase electrical fault. The expelled ionized gases could also cause a phase-to-ground failure with a grounded metallic panelboard enclosure within which the circuit breaker is mounted.

The circuit breaker housing must therefore be robustly coupled together to safely withstand the high pressures generated during an arcing event. Typically, a strong and relatively expensive molding material such as sheet molding compound (SMC) is used to form the housing, which requires a relatively expensive compression molding process.

It is also important that the corresponding housing pieces be mated together tightly along the seam to minimize an egress of the conductive gasses therethrough to prevent injury to nearby personnel or equipment. Since conventional circuit breaker housing portions are fastened together using strong mechanical fasteners such as rivets, undesired localized stresses in the mating housing portions may form, and thus s thickening or otherwise strengthening of the housing in the riveted areas is required. It would be advantageous to provide a strong circuit breaker housing with a robust, sealed seam formed using less expensive materials and rigidly joined together with fewer, or without, the use of mechanical fasters.

BRIEF DESCRIPTION OF THE INVENTION

In an exemplary embodiment, a circuit breaker housing or cassette assembly is disclosed. The housing includes a first housing piece defining a first interior surface including a first mating surface, and a second housing piece defining a second interior surface including a second mating surface which is opposingly coupled to the first mating surface to define a seam therebetween. An adhesive material is disposed between the corresponding first and second mating surfaces along the seam. A moveable contact is disposed in the housing and is selectively moveable with respect to a corresponding stationary contact. The first and second interior surfaces further cooperatively define a first recess therebetween, and the moveable contact assembly is disposed in said first recess.

DETAILED DESCRIPTION OF THE INVENTION

Exemplary embodiments of circuit protection systems and apparatus are described herein. These embodiments enhance the quenching and controlling of gases, heat, and pressure that are generated within a circuit breaker after an arc is generated.

While various embodiments are described herein with reference to an electrical circuit breaker having one or more moveable rotary contacts, other contemplated embodiments are not so limited and may also embody other electrical devices having any number or type of moveable contacts, for example, switches or electrical switching devices such as single or multi-pole circuit switching devices, including contactors, motor starters, motor controllers, and other load controllers.

Figure 7:
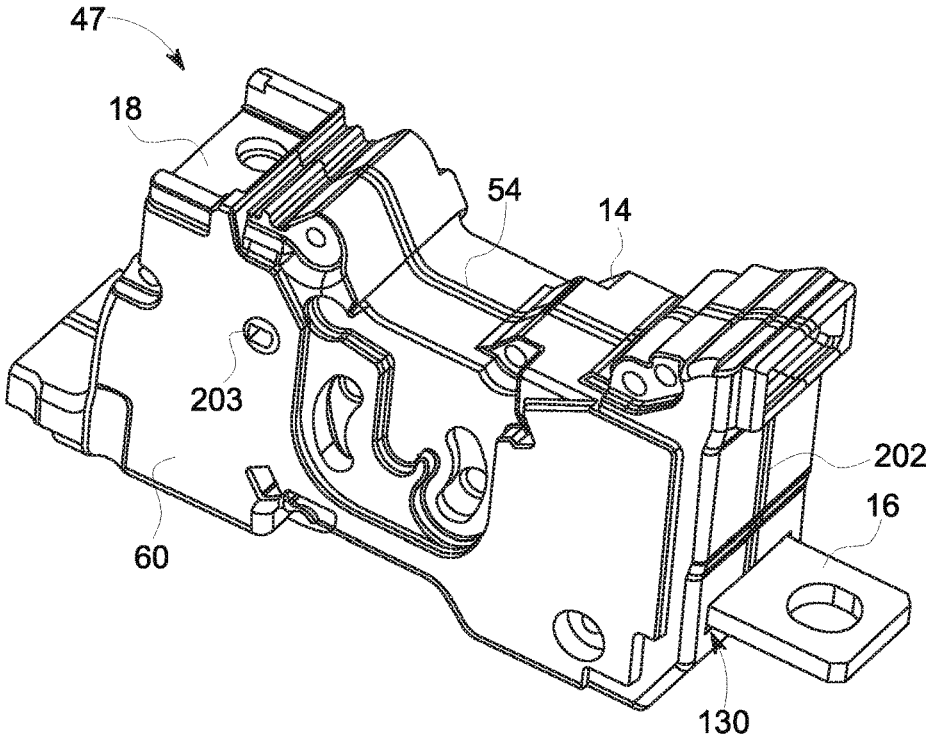
FIG. 7 is a perspective view of an embodiment of a housing assembly comprising the first and second housing halves of FIGS. 2 and 3 assembled together.
Figure 8:
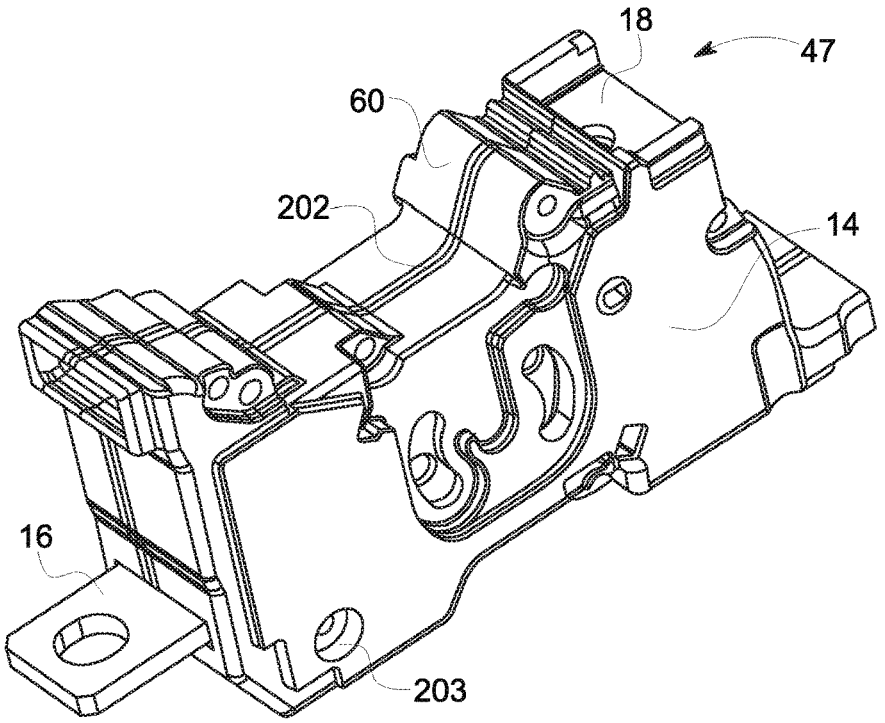
FIG. 8 is a perspective view depicting the opposite side of the housing assembly of FIG. 7.
Figure 9:
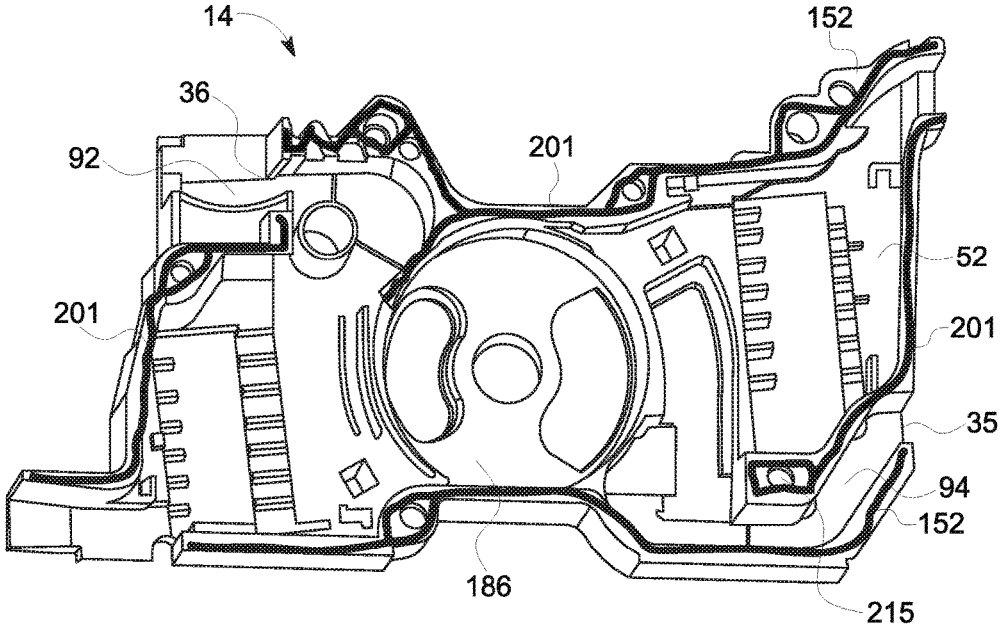
FIG. 9 depicts the embodiment of the housing piece of FIG. 3 with an adhesive material applied to a portion of the first mating surface.

As described herein, a housing 47 (FIGS. 7, 8) such as for a rotary-contact type circuit breaker, may utilize a first electrically insulative housing piece 14 and a second electrically insulative housing piece 60 arranged to mate with each other to cooperatively form the housing 47. While the housing 47 is described herein as comprising two mating half-pieces 14, 60, it will be appreciated that embodiments may comprise a plurality of any number of pieces joined to form the enclosure 47 without departing from the scope of the claims herein. As further described herein, a housing 47 for a movable-contact type circuit breaker utilizes the first housing piece 14 and the second housing piece 60 arranged to adhesively mate using an adhesive element 201 (FIG. 9) disposed therebetween and thereby form an enclosure. In an embodiment, the adhesive element 201 (FIG. 9) also seals the housing 47 along at least a portion of the seam 202 between the first and second housing pieces 14, 60 in order to strengthen the seam 202 to prevent fracture of housing 47 during an arcing event.

Figure 1:
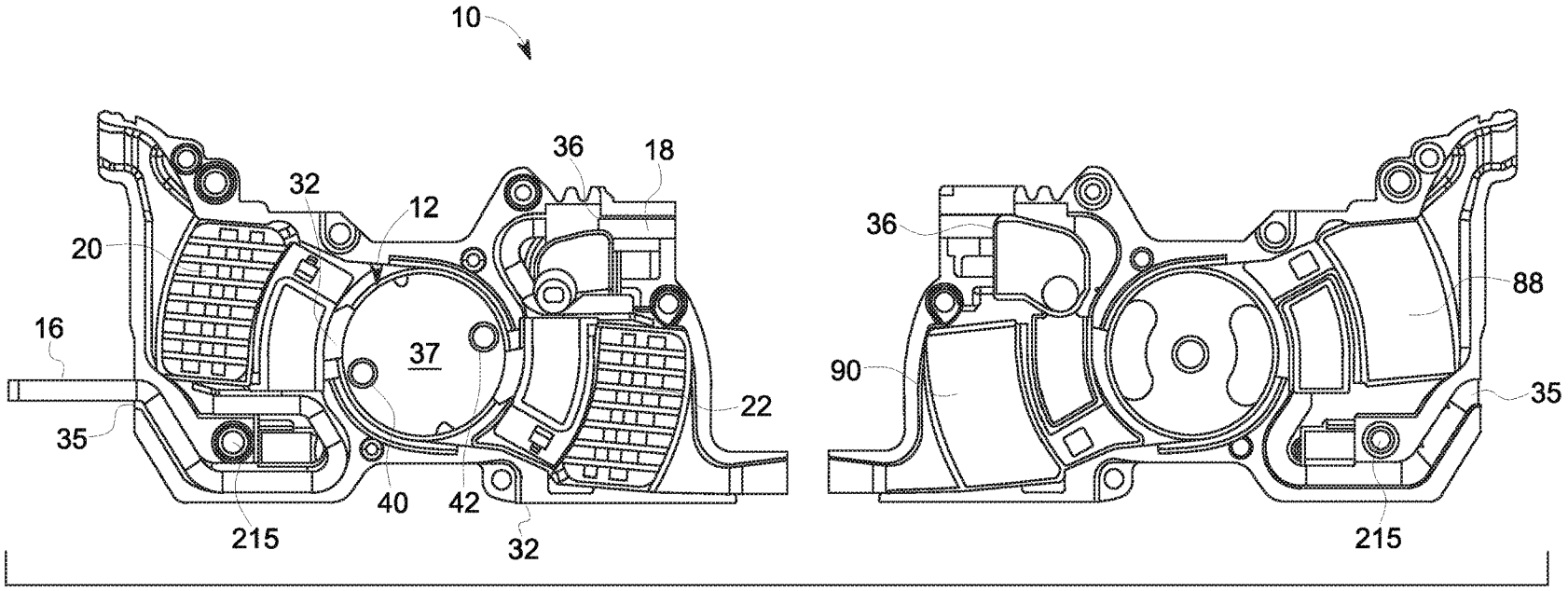
FIG. 1 depicts a front view of an embodiment of a circuit breaker housing assembly with the mating first housing piece separated from the second housing piece and rotated for clarity.

Referring to FIG. 1, an embodiment of a circuit breaker 10 is shown in a partially assembled state with the first electrically insulative housing piece 14 and the corresponding second electrically insulative housing half piece 60, depicted as removed and in an unassembled condition, with some elements omitted, for clarity. A rotary contact assembly 12, a circuit breaker conductive line-side contact strap 16, a conductive load-side contact strap 18 and corresponding arc chutes 20, 22 are disposed therein. The line-side contact strap 16 is configured to be electrically coupled to line-side wiring (not shown) in an electrical distribution circuit, and the load-side contact strap 18 (FIG. 7) is similarly configured to be electrically coupled to load-side wiring (not shown) via a lug (not shown) or some other known device such as a bimetallic element or current sensor (not shown). A line-side contact strap opening 35, and a load-side contact strap opening 36, are defined within the housing pieces 14, 60 to allow the respective line-side contact strap 16 and load-side contact strap 18 to pass therethrough. Although a single rotary contact assembly 12 is shown, it will be understood that a separate rotary contact assembly 12 may be employed within each pole of a multi-pole circuit breaker and operate in a similar manner.

Figure 16:
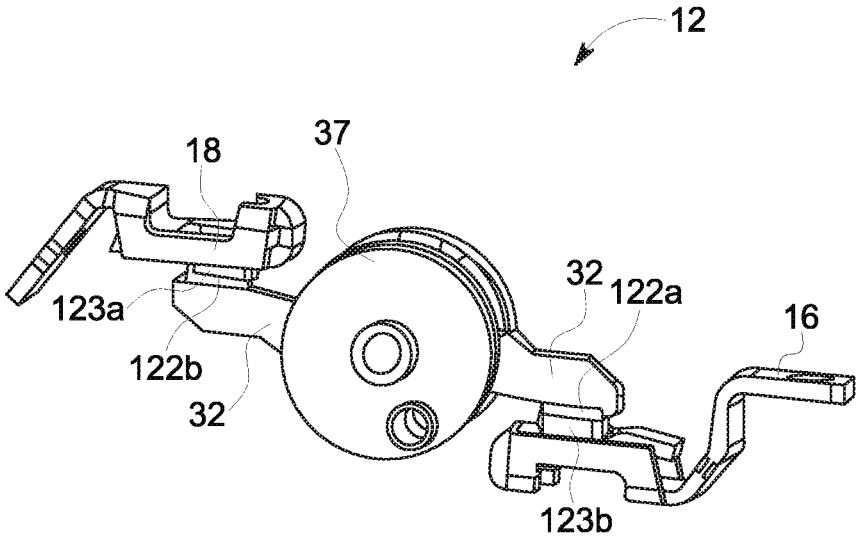
FIG. 16 depicts a detailed perspective view of the current path of an embodiment with all other parts removed for clarity.
Figure 17:
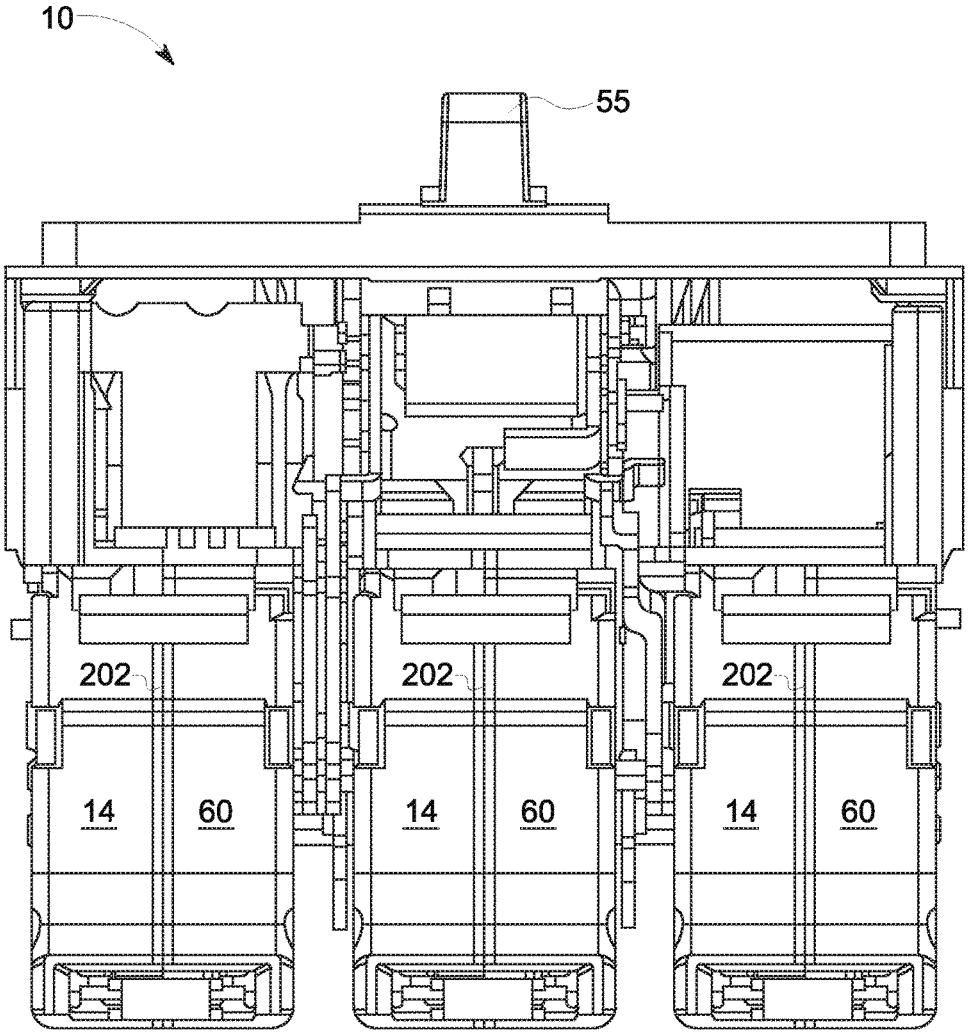
FIG. 17 depicts a perspective view of an alternative embodiment of a circuit breaker comprising three housing assemblies arranged in a 3-pole circuit breaker.

Generally, in operation, an electrical current flows through the circuit breaker 10 conductive parts disposed within housing 47. With reference to FIG. 16, where an alternative embodiment of an electrical current path 112 through a circuit breaker 10 is shown with all other parts removed for clarity, the electrical current may proceed from the line-side contact strap 16*a* to a first fixed contact 123*b* and a corresponding first moveable contact 122*a* disposed at one end of a movable contact arm 132, then to second moveable contact 122*b* disposed at a second end of the moveable contact arm 132, then to a second fixed contact 123*a*, then to the load-side contact strap 18. The movable contact arm 32 is retained between two halves of a circular rotor 137 and arranged to move in unison with the rotor 137. For example, in response to a manual articulation of a handle 55 of the circuit breaker 10 operating mechanism (not shown) the first and second movable contacts 122*a*, 122*b* are selectively driven between a CLOSED and an OPEN position with respect to their corresponding fixed contacts 123*a*, 123*b*. A first rotary contact spring 33 disposed within one side of the rotor 37, and a second rotary contact spring 34 disposed within the opposite side of rotor 37, extend between a pair of spring mounting pins (not shown).

The arc chute assemblies 20, 22 are positioned within the electrically insulative housing half piece 60 and adjacent the respective pairs of first fixed and first moveable contacts 123*a*, 122*b* and second fixed and second moveable contacts 123*b*, 122*a*. The first and second movable contacts 122*b*, 122*a* and moveable contact arm 32 move in order to selectively engage and disengage the respective first and second fixed contacts 122*b*, 123*b*. Each arc chute assembly 20, 22 is adapted to interrupt and extinguish the arc which forms when the circuit breaker 10 is tripped, for example in response to an electrical fault, and the first and second moveable contacts 122*b*, 122*a* are suddenly separated from the first and second fixed contacts 123*a*, 123*b*.

Figure 3:
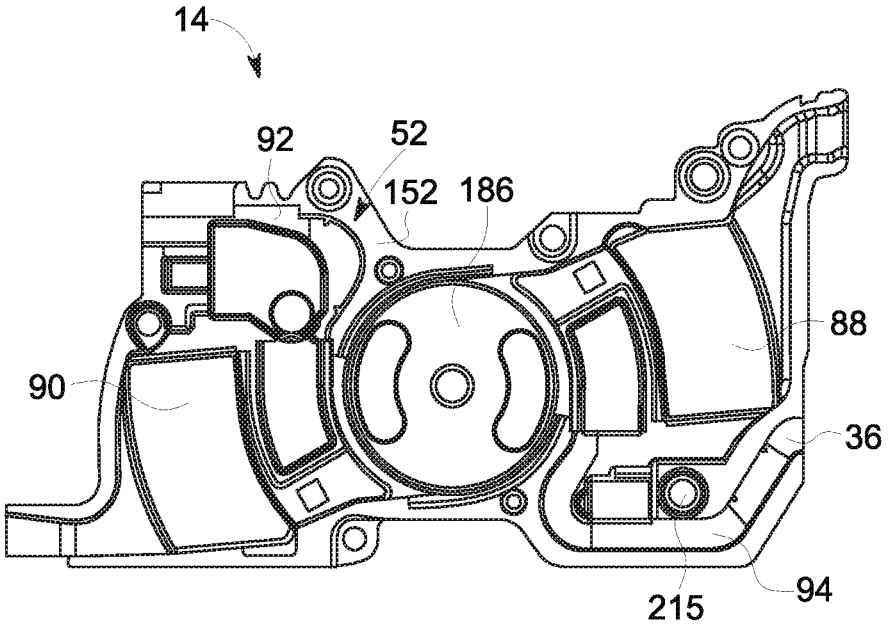
FIG. 3 depicts an embodiment of the second electrically insulative housing piece.

Referring to FIG. 3, an embodiment of a first electrically insulative housing half piece 14 is shown. The first electrically insulative housing half piece 14 has a first interior surface 52. A first rotor recess 186 is also formed on the interior surface 52 and operatively receives the rotor 37 therein. Arc chute recesses 88, 90 are formed on the interior surface 52 on opposite ends of the rotor recess 86 and operatively receive the respective arc chute 20, 22 therein. Load-side and line-side contact strap recesses 92, 94 are also formed on the interior surface 52 proximate the arc chute recesses 88, 90 sized and disposed to operatively receive the respective line-side and load-side contact straps 18, 16 therein. In an embodiment, load-side and line-side contact strap recesses 92, 94 extend to the corresponding load side and line-side contact strap openings 36, 35, allowing the corresponding load-side and line-side contact straps 18, 16 to protrude from the housing 47. A first mating surface 152 is formed on the interior surface 52 and cooperatively mates with a second mating surface 260 formed on the second housing half piece 60 (FIG. 3) to form the housing 47.

Figure 2:
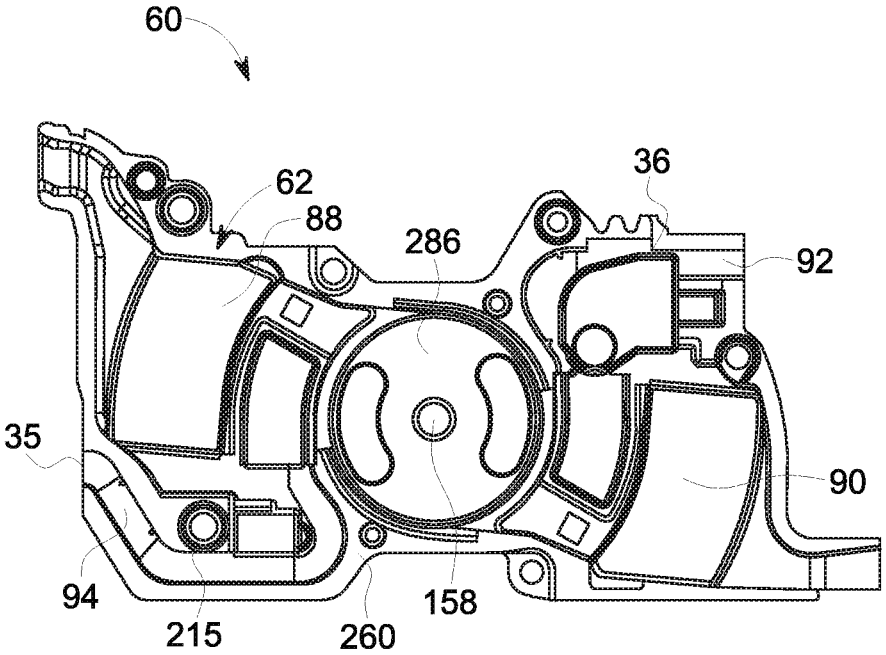
FIG. 2 depicts an embodiment of the first electrically insulative housing piece.

Referring to FIG. 2, an embodiment of the second electrically insulative housing half piece 60 is shown with circuit breaker electrical parts removed for clarity. Second electrically insulative housing half piece 60 has an interior surface 62. A second rotor recess 286 is also formed on the interior surface 62. Arc chute recesses 88, 90 are formed on the interior surface 62 on opposite ends of the second rotor recess 286 and are sized to operatively receive the respective arc chute 20, 22 therein. Load-side and line-side contact strap recesses 92, 94 are also formed on the interior surface 62 proximate the arc chute recesses 88, 90. In an embodiment, load-side and line-side contact strap recesses 92, 94 extend to the corresponding load side and line-side contact strap openings 36, 35, allowing the corresponding load-side and line-side contact straps 18, 16 to protrude from the housing 47. The second mating surface 260 is formed on the interior surface 62 and cooperatively mates with the first mating surface 152 of the first insulative housing half 14 to form the housing 47.

In an embodiment, second electrically insulative housing half piece 60 is bonded to the first electrically insulative housing half piece 14 (FIG. 2) by a suitable adhesive 201. When the first and second housing half pieces 14, 60 are joined, at least a portion of the opposing first and second interior surfaces 52, 62 cooperatively define at least one first interior recess 120 or cavity between the first and second housing pieces 14, 60. In alternative embodiments, the at least one first recess 120 may be used to locate various circuit breaker elements such as conductors, sensing elements (not shown), and rotor 37. For example, in an embodiment, a rotor recess 186 defined in the first housing half 14, and corresponding rotor recess 286 defined in the second housing half 60, may cooperatively form the first interior recess 120 therebetween. In other embodiments, the first interior recess 120 may be cooperatively defined by a cavity, such as rotor recess 186, defined in one of the first and second housing half pieces 14, 60, and an opposing one of the corresponding first and second interior surfaces 52, 62. In another embodiment, the line-side and load-side contact strap recesses 92, 94 may cooperatively form at least one second interior recess 130.

In an embodiment, (FIGS. 7, 8) when the first and second housing half pieces 60, 14, are joined, the corresponding first and second mating surfaces 152, 260 are opposingly arranged to engagingly overlap and thereby define a seam 202 therebetween. The adhesive 201 is disposed to uniformly distribute the stress over the entire overlapping region between the first and second housing halves 60, 14. By adhesively joining the opposing corresponding mating surfaces 152, 260, the stress distribution characteristics, inherent toughness, vibration damping resistance, and electrical and thermal insulation properties of the adhesive 201 may be applied. Accordingly, a circuit breaker housing 42 is provided having improved dielectric performance over the prior art.

In other embodiments, one or more mechanical fasteners 203, such as rivets or screws, may additionally be used in cooperation with the adhesive 201 material to mechanically join the first and second housing half pieces 14, 60. The one or more fasteners 203, may be disposed in corresponding aligned through-holes or apertures 215 provided in the respective first and second housing half pieces 14, 60 and arranged therethrough to provide a clamping force.

Figure 4:
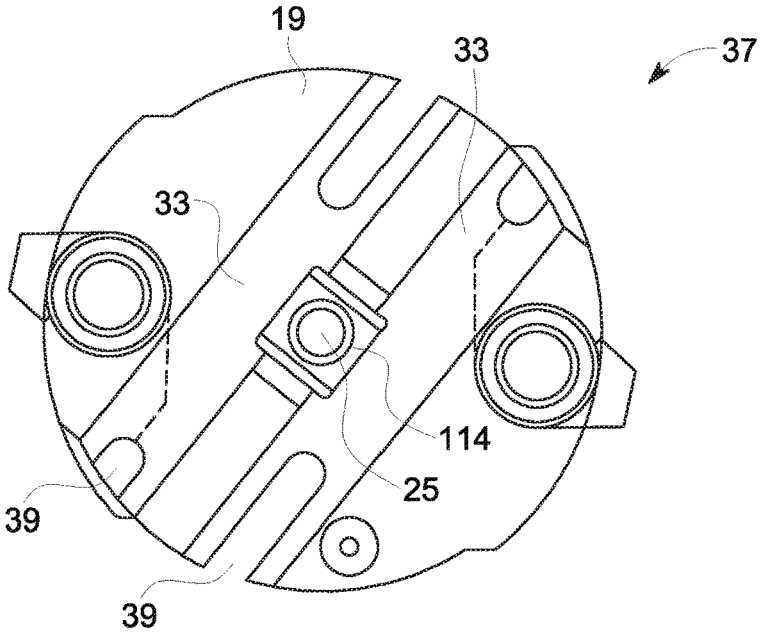
FIG. 4 depicts an exemplary rotor employed an the embodiment.

Referring to FIG. 4, a circular rotor 37 is shown. When operatively positioned in the second electrically insulative housing half piece 60 (FIG. 2), the rotor 37 is rotatably supported by a shaft (not shown) and rotatably and axially mounted inside first electrically insulative housing half piece 14 (FIG. 2). One or more rotor springs 33, 34 (FIG. 10) are positioned in rotor 37. A pivot pin 25 extends from a central portion of the moveable contact arm 32 to a central portion of the rotor 37 to allow rotation of the moveable contact arm 32 with respect to the rotor 37. A molded pin 114 may extend from the face 19 of rotor 37.

In an embodiment, the rotor 37 is assembled into second electrically insulative housing half piece 60 by locating pin 114 into a centrally located aperture 158. The pin 114 locates rotor 37 within rotor recess 68 in spaced relationship from the first and second mating surfaces 152, 260, and permits operational travel of the rotor 37 within the recess 68. By disposing pin 114 into aperture 158 into the second electrically insulative housing half piece 60 during assembly of the rotor 37 into second housing half piece 60, the rotor 37 will be spaced from said seam 202, to prevent inadvertent or undesired contact by the rotor 37 with the adhesive 201 during assembly. Additionally, as discussed in further detail herein, a blocking element 102 may additionally be disposed to prevent excess adhesive 201 from contacting the movable rotor 37.

Figure 5:
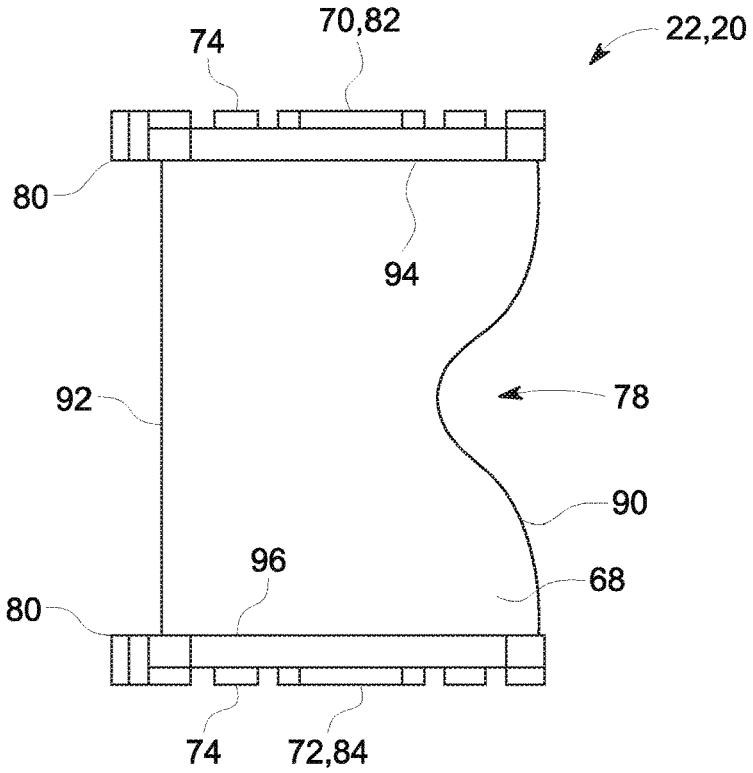
FIG. 5 is a top view of an exemplary arc chute assembly.

Referring to FIG. 5, the arc chute assembly 22 for a circuit breaker is shown. The arc chute assembly 22 includes a plurality of plates 68, a first side member 70 and a second side member 72. Typically, the plates 68 are metallic so as to induce magnetism thereby promoting removal of an arc generated by a short circuit interruption by the circuit breaker. Each plate 68 has a first edge 90, a second edge 92 opposing the first edge 90, a third edge 94 and a fourth edge 96 opposing the third edge 94. The first edge 90 and the second edge 92 are positioned between the third and fourth edges 94, 96, as shown in FIG. 5. Each plate 68 has a protrusion 74 extending from the third edge 94 and the fourth edge 96.

Figure 6:
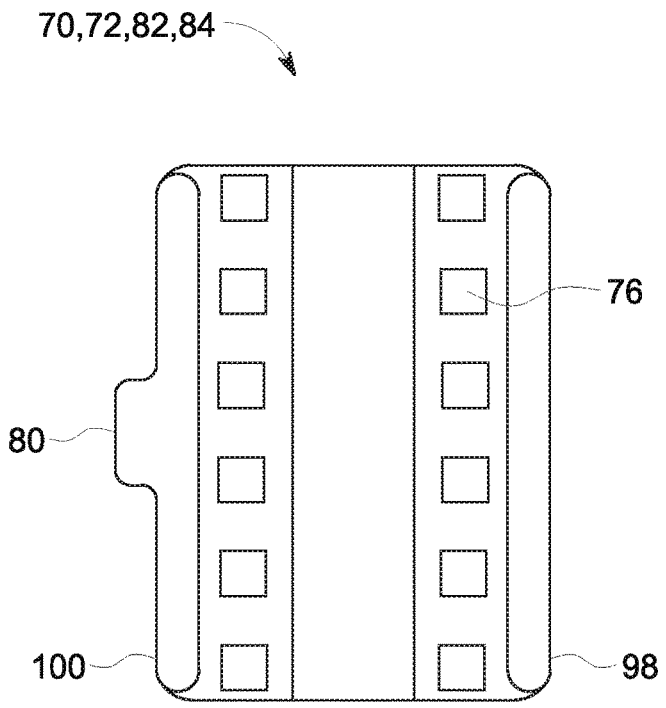
FIG. 6 is a view of an arc chute side member employed in the arc chute assembly of FIG. 5.

Referring to FIGS. 5 and 6, first and second side members 70, 72 have a plurality of slots 76 formed therethrough. The protrusions 74 of the plates 68 are respectively inserted into a corresponding one of the slots 76 formed in the first and second side members 70, 72. The plates 68 are disposed in this manner between the first and second side members 70, 72 and are arranged in a stacked, spaced-apart relationship to each other. Second side member 72 is identical to first side member 70. The first and second side members 70, 72 are assembled so as to be opposedly oriented to each other. First and second side members 70, 72 each include a first end 98 and an opposing second end 100. First side member 70 has a tab 80 centrally located on the second end 100 opposite to the radiused notch 78. A tab 80 is similarly located along second side member 72.

A second arc chute assembly 20 comprises a plurality of plates 68 and third and fourth side members 82, 84. Third and fourth side members 82, 84 are identical to first and second side members 70, 72. Third and fourth side members 82, 84 are assembled so as to be opposedly oriented to each other. Third side member 82 has a tab 80 centrally located on an end opposite to the radiused notch 78 of the plate 68. A tab 80 is similarly located along the fourth side member 84.

In an embodiment, the first arc chute assembly 22 is positioned into the first electrically insulative housing half piece 14. Similarly, the second arc chute assembly 20 is positioned into the first electrically insulative housing half piece 14.

Referring now to FIGS. 2-5, in an embodiment, after the first and second arc chute assemblies 22, 20 and all other desired circuit breaker elements needed for proper functioning are assembled into the first electrically insulative housing half piece 14, the second electrically insulative housing half piece 60 is placed over the first electrically insulative housing half piece 14 to form a complete enclosure. Alternatively, it will be understood that the first and second arc chute assemblies 22, 20 and other desired circuit breaker elements needed for proper functioning are assembled into the second electrically insulative housing half piece 60, the first electrically insulative housing half piece 14 may be is placed over the second electrically insulative housing half piece 60 to form a complete enclosure.

In an embodiment, prior to joining the first and second insulative housing half pieces 14, 60, an adhesive 201 material is applied to the second mating surface 260 of the second insulative housing half piece 60. Alternatively, the adhesive 201 material could instead be applied to the first mating surface 152 of the first insulative housing half piece 14. In other embodiments, the adhesive material 201 is placed on both the first and second mating surfaces 152, 260 of the first and second insulative housing half pieces 14, 60. After the application of the adhesive 201 to the selected mating surface 152, 260, the first and second housing half pieces 14, 60 are then carefully joined, aligning the first and second mating surfaces 152, 260 with the adhesive 201 disposed therebetween. The housing assembly may then be clamped until the adhesive material has set-up or sufficiently cured. Alternatively, the housing assembly may be additionally be clamped by fasteners 203 such as rivets, screws or clips disposed in the corresponding aligned through-holes or apertures 215, 225 provided in the respective first and second housing half pieces 14, 60.

It is important that the adhesive 201 be carefully applied, and be prevented from flowing or otherwise migrating into the interior recesses or cavities defined in the housing interior, such as first interior recess 120, particularly in the vicinity of the circuit breaker moving parts, such as the rotor 37 and moveable contact arm 32. As can be seen in the cross-sectional views of FIGS. 10-12 and FIG. 14, at least one of the first and second mating surfaces 152, 260 are further provided with a blocking element 102. The blocking element 102 is configured to prevent or block the flow of any adhesive 201 into the interior recess 120 of the housing assembly. Since the seam 202 comprises an interior portion 53, i.e., proximal to the housing 47 interior, and an exterior portion 54, i.e., proximal to the housing 47 exterior, the blocking portion 102 is in an embodiment disposed between said interior portion 53 of the seam 202 and the first interior recess 120. In an embodiment, the blocking element 102 is biasedly disposed on the inboard portion of the at least one of the first and second mating surfaces 152, 260. In another embodiment, the blocking element 102 is disposed between the adhesive material 201 and first interior recess 120. In some embodiments, the blocking element 102 is integrally formed, for example by compression or injection molding, with at least one of the first and second mating surfaces 152, 260. In another embodiment, the blocking element 102 comprises a third surface 132 oriented at an angle to the first and said second mating surfaces 152, 260. The third surface 132 is oriented to block a flow of adhesive 201 from the seam 202. For example, in an embodiment, a moveable contact assembly 12 is operably disposed in said first interior recess 120, and the blocking element 102 is disposed along at least one of said first and second mating surfaces 152, 260 proximal to the movable contact assembly 12.

Figure 10:
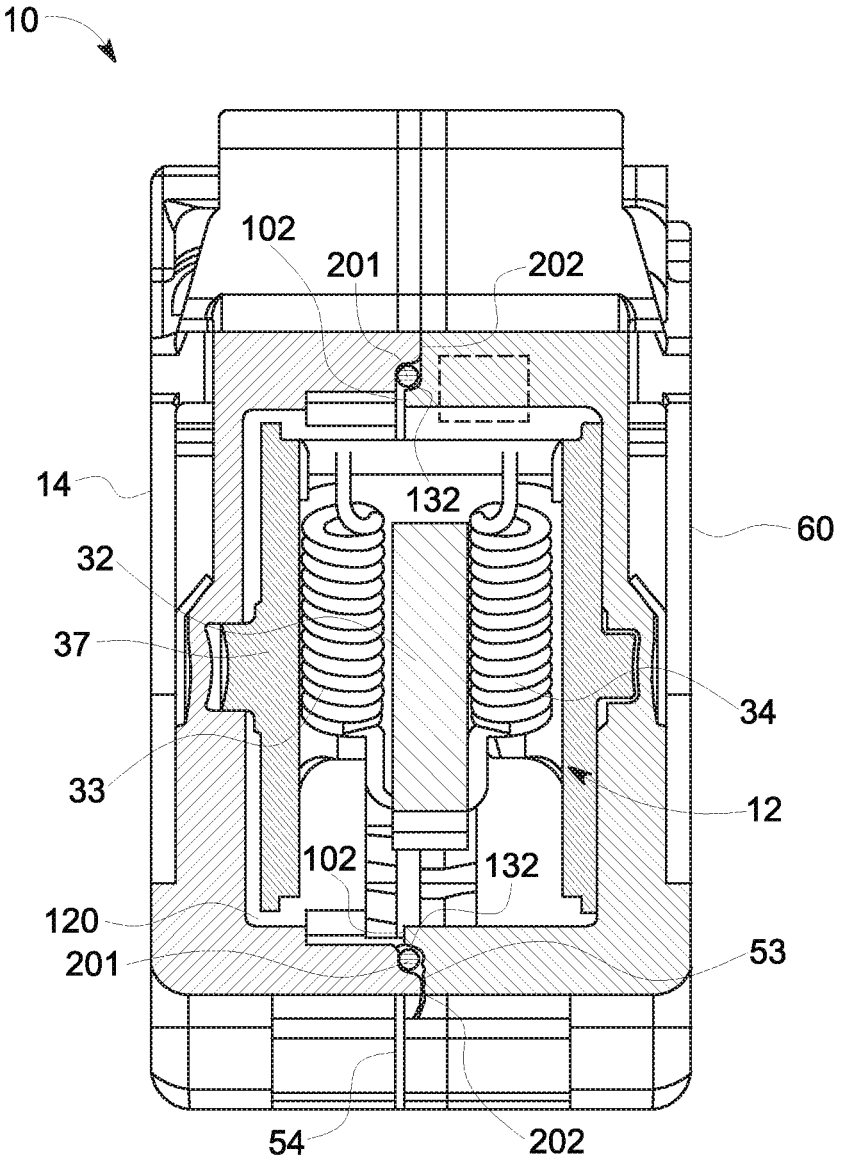
FIG. 10 depicts an end view partial cross-section of an embodiment.
Figure 11:
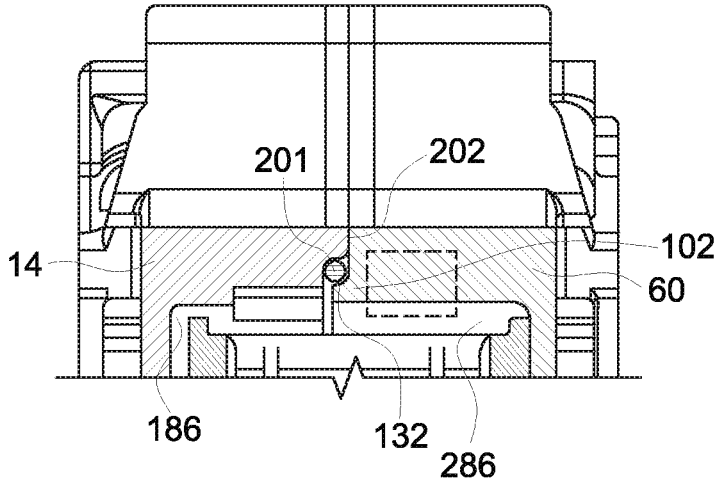
FIG. 11 is a close up view of a portion of the embodiment of FIG. 10.
Figure 12:
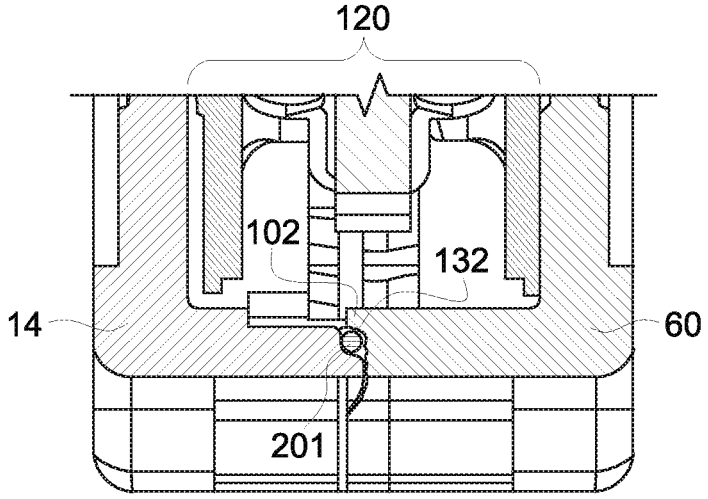
FIG. 12 is a close up view of another portion of the embodiment of FIG. 10.

In various embodiments, the blocking element 102 may define one or more of a wall, rib, lip, dam, groove, and trough. While the blocking element 102 in the embodiment of FIG. 10 is depicted as a wall or dam, it will be appreciated that any number of alternative blocking element 102 geometries may be employed to perform the adhesive 201 blocking function without departing from the scope of the invention. For example, one of a trough, ridge, or rib may alternatively be disposed individually or in combination to block a flow of the adhesive 201 into the first interior recess 120.

Figure 13:
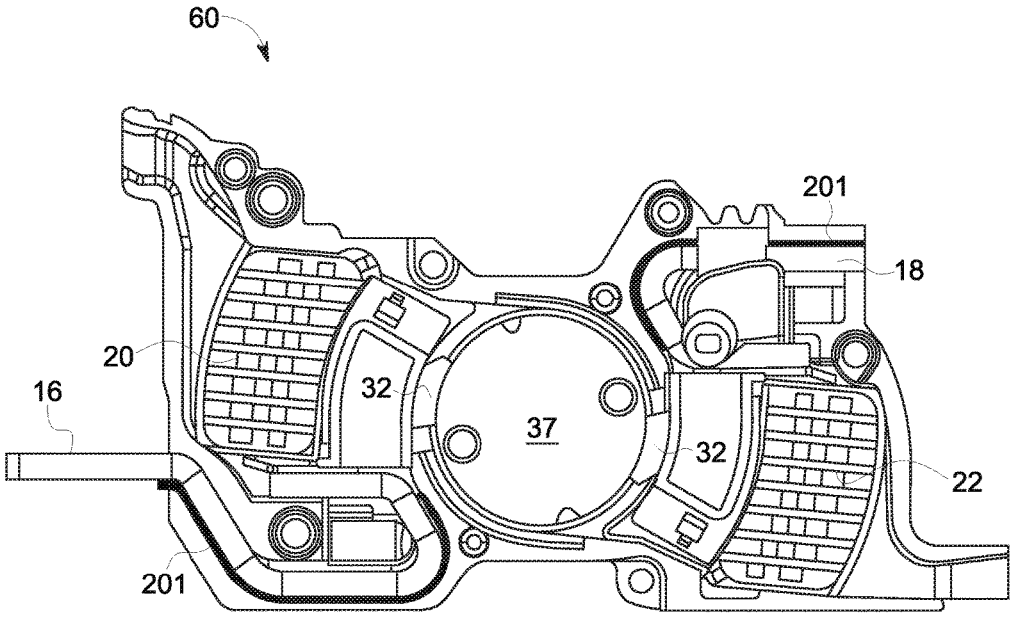
FIG. 13 depicts an embodiment of one of the housing pieces of FIG. 1 with adhesive applied to a portion of the mating surface.
Figure 14:
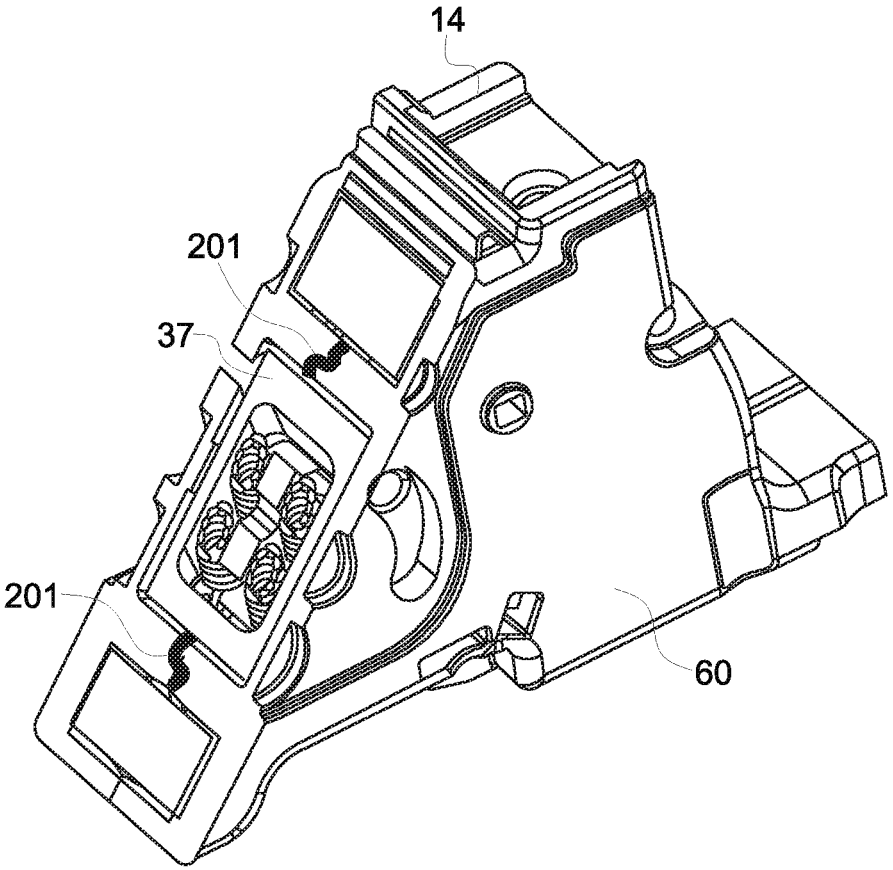
FIG. 14 depicts a partial cross-section perspective view of the embodiment of FIG. 8.
Figure 15:
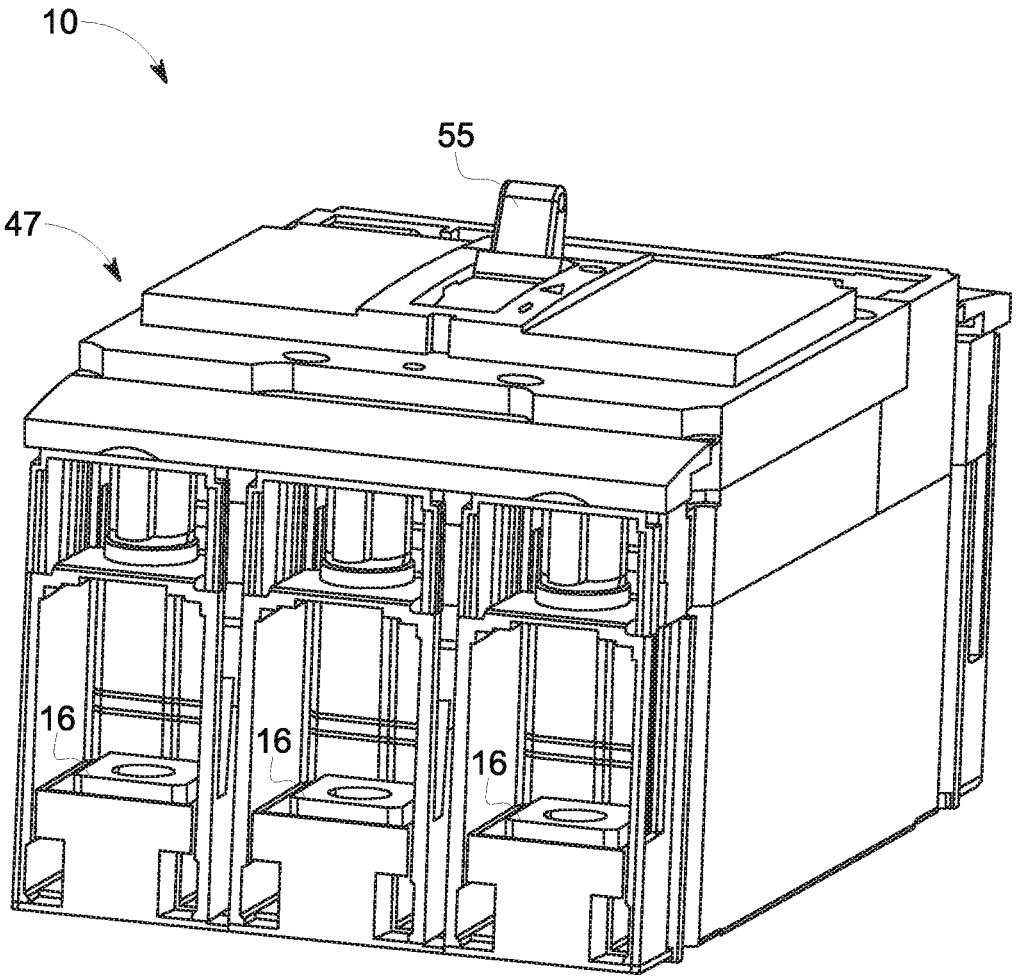
FIG. 15 depicts a perspective view of an embodiment of a circuit breaker comprising three housing assemblies arranged to comprise a 3-pole circuit breaker.

In an embodiment, the line-side and load-side contact strap recesses 92, 94 are communicatively coupled in flow communication to the respective line-side and load-side contact strap openings 35, 36; and the first and second mating surfaces 152, 260 are arranged proximal to at least one of the line-side and load-side contact strap recesses 92, 94. Additionally, in an embodiment, and as depicted in of FIG. 13, the blocking element 102 is omitted in the region proximal to at least one of the line side and load side straps 16, 18. The absence of the blocking element 102 in this region allows a flow of the adhesive 201 into the line-side and load-side contact strap recesses 92, 94 during assembly of housing 47. When cured, the adhesive 201 is thus disposed within the line-side and load-side contact strap recesses 92, 94 and acts to seal the line-side and load-side contact strap openings 35, 36 and to thus prevent undesired venting of arcing gasses therethrough out of the housing 47 during an arcing event.

The adhesive 201 may be chosen from adhesive systems of varying compositions and chemistries and must be capable of withstanding the high temperatures and high pressures generated during arcing events. The adhesive 201 is a structural adhesive made from thermoset polymeric resins such as epoxy and polyurethane. Such structural adhesives may provide high shear and tensile strength and good environmental resistance.

In various embodiments, adhesive 201 may comprise either thermosetting or thermoplastic adhesives. Thermosetting adhesives include, but are not limited to one or two component epoxy and polyurethane, epoxy hybrids, acrylic, cyanoacrylates, phenolics, polyesters, polysulfide, anaerobic and room temperature vulcanizing (RTV) silicones. Thermoplastics adhesives include, but are not limited to thermoplastics resin based polyamide, polyester, polysulfone, polyolefins, phenoxy, and elastomeric resins based butyl rubber, styrene butadiene copolymers, polychloroprene, polyisobutylene and silicone elastomers.

Adhesive 201 may alternatively comprise Hybrid systems adhesives based on silane modified polymers (SMP) that are solvent-free and isocyanate-free and based on either polyether modified silanes and polyurethane modified silanes, and are not limited to silane terminated prepolymers (STP) and silane terminated urethane (STU).

In yet other embodiments, the adhesive 201 may comprise various types of sealants which include but are not limited to hydrocarbon rubber-based, acrylic, polysulfides, polyethers, polyurethane, silicones and epoxy.

Selection of a high strength adhesive 201 enables uniform distribution of the developed stresses during an arcing event over the overlapped region of the corresponding mating surfaces 152, 26. Additionally, the additional strength provided by the adhesive 201 enables use of less expensive molding materials to form the housing halves 14, 60. For example, a bulk molding compound may be selected (BMC), which uses along with a less expensive molding process (injection molding) as compared to using SMC and compression molding when using mechanical rivets only to join the housing halves. Moreover, by reducing or eliminating the need for mechanical fasteners, the weight and cost of the final assembly is reduced. Another advantage of the embodiments disclosed herein, by using a structural adhesive for adhesive 201 is improved stress-distribution characteristics and inherent toughness provided by such adhesives yields bonds with superior fatigue resistance and resistance to vibration due to the viscoelastic properties of such adhesives. Yet another advantage is that the adhesive 201 additionally functions as an electrical and thermal insulator in the joint or seam 202 between the housing halves 14, 60.

In some embodiments, the housing halves 14, 60 are adhesively joined using an adhesive 201 without the use of mechanical fasteners 203. In other embodiments, a combination of adhesive 201 and mechanical fasteners 203 are used. Embodiments employing the combination of adhesive 201 and fasteners 203 can provide properties that are superior to either adhesive bonding or mechanical fastening alone. For example, the number of mechanical rivets 203 needed can be reduced without sacrificing strength and reliability. Additionally, when assembling a housing employing a combination of adhesive 201 and mechanical fasteners 203, the fasteners 203 may be employed to provide a holding or clamping force to fix the housing assembly while the adhesive 201 cures. In this way, expensive fixturing equipment and associated setup are avoided. Additionally, delays in the assembly process due to adhesive cure time are thereby eliminated or reduced to speed the overall assembly process.

In an embodiment, the corresponding first and second mating surfaces of first and second housing halves are thoroughly cleaned prior to application of the adhesive 201 and assembly. For example, a plasma treatment of the substrates for the adhesive 201, that is the first and second mating surfaces, by not using any conventional cleaning or pretreatment process. By using plasma treatment, an improved adhesion is obtained via surface modification and increased surface energy. In an embodiment, simultaneous ultrafine cleaning to remove all organic contaminants and dirt prior to bonding is performed.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but rather that the invention will include all embodiments falling within the scope of the appended claims.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit breaker comprising:

a housing comprising:

a first housing piece having a first interior surface defining a first mating surface;

a second housing piece having a second interior surface defining a second mating surface, wherein said first and second interior surfaces cooperatively define a first recess therebetween, and said second mating surface is opposingly coupled to said first mating surface to define a seam therebetween; and an adhesive material disposed between said first and second mating surfaces along said seam;

a moveable contact assembly selectively moveable with respect to a corresponding stationary contact, wherein said moveable contact assembly is operatively disposed in said housing, and said moveable contact assembly is further disposed in said first recess; and a blocking element disposed along at least a first portion of said seam and oriented to block an ingress of said adhesive material into said first recess.

2. The circuit breaker of claim 1, wherein said seam defines an interior portion and an exterior portion, and said blocking element is disposed between said interior portion and said first recess.

3. The circuit breaker of claim 1, wherein said blocking element is further disposed between said adhesive material and said first recess.

4. The circuit breaker of claim 1, wherein said blocking element defines a third interior surface oriented at an angle to said first and said second interior surfaces.

5. The circuit breaker of claim 1, wherein said blocking element is integrally formed with at least one of said first and second mating surfaces.

6. The circuit breaker of claim 1, wherein said blocking element is at least one of a wall, rib, lip, dam, groove, and trough.

7. The circuit breaker of claim 1, wherein said blocking element is further disposed proximal to said movable contact assembly.

8. The circuit breaker of claim 1, wherein:

said housing further defines an opening therethrough;

said first and second interior surfaces further cooperatively define a second recess therebetween, said second recess extending to said opening;

a conductor is disposed in said second recess; and said adhesive material is disposed within a portion of said second recess between said conductor and at least one of said first and second interior surfaces to prevent venting of a gas out of the housing.

9. The circuit breaker of claim 8, wherein said blocking element disposed along at least the first portion of said seam is omitted from a second portion of said seam proximal to said second recess.

10. The circuit breaker of claim 1, wherein:

a portion of said first recess is defined by respective conductive strap recesses opposingly disposed in said first and second interior surfaces;

a conductive strap is disposed in said first recess; and said adhesive material is disposed within said first recess between the first and second interior surfaces and said conductive strap to prevent an egress of gasses from the first recess during an arcing event.

11. The circuit breaker of claim 1, wherein the adhesive material is selected from a group consisting of thermosetting adhesives, thermoplastic adhesives, hybrid adhesive systems, and sealants.

12. The circuit breaker of claim 1, wherein said first and second housing pieces are further coupled by at least one mechanical fastener.

13. The circuit breaker of claim 12, wherein the at least one mechanical fastener comprises at least one of a rivet, screw, or dip.

* * * * *